US008523012B2

(12) United States Patent
Richardson et al.

(10) Patent No.: US 8,523,012 B2
(45) Date of Patent: Sep. 3, 2013

(54) MERCHANDISE DISPLAY HOOK HAVING TIME DELAY MECHANISM INCLUDING HELIX

(75) Inventors: Justin A. Richardson, Waxhaw, NC (US); Michael R. Johnston, Waxhaw, NC (US); John F. Roberts, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 295 days.

(21) Appl. No.: 12/853,513

(22) Filed: Aug. 10, 2010

(65) Prior Publication Data

US 2011/0036789 A1 Feb. 17, 2011

Related U.S. Application Data

(60) Provisional application No. 61/233,331, filed on Aug. 12, 2009.

(51) Int. Cl.

| | |
|---|---|
| ***B65H 3/00*** | (2006.01) |
| *G07F 11/24* | (2006.01) |
| *E05B 73/00* | (2006.01) |
| *E05B 65/00* | (2006.01) |
| *E05B 19/26* | (2006.01) |
| *B42F 17/02* | (2006.01) |

(52) U.S. Cl.

USPC ..... 221/251; 221/277; 211/7; 211/51; 70/57.1; 70/413

(58) Field of Classification Search

USPC ..... 211/4, 7, 59.1–59.3, 57.1, 51; 248/551, 248/225.21, 224.8, 304, 303; 221/251, 277, 221/279; 70/14, 57.1, 62, 276, 413

See application file for complete search history.

(56) References Cited

U.S. PATENT DOCUMENTS

| | | | | |
|---|---|---|---|---|
| 3,400,857 | A * | 9/1968 | Schubert | 221/93 |
| 4,308,974 | A * | 1/1982 | Jones | 221/196 |
| 4,600,119 | A * | 7/1986 | Olson | 221/75 |
| 4,638,922 | A | 1/1987 | Stoltz | |
| 6,464,089 | B1 | 10/2002 | Rankin, VI | |
| 6,659,291 | B2 * | 12/2003 | Huehner et al. | 211/4 |
| 6,957,555 | B1 * | 10/2005 | Nagel et al. | 70/57.1 |
| 7,197,902 | B1 * | 4/2007 | Barkdoll | 70/57.1 |
| 7,392,673 | B2 * | 7/2008 | Fawcett et al. | 70/14 |

(Continued)

*Primary Examiner* — Joshua J Michener
*Assistant Examiner* — Devin Barnett
(74) *Attorney, Agent, or Firm* — InVue Security Products Inc.

(57) ABSTRACT

A merchandise display hook has a time delay mechanism for increasing the amount of time required to dispense items of merchandise from a display arm, while permitting bulk loading of the items of merchandise onto the display arm. The time delay mechanism includes a housing, a helix extending from the housing in a rearward direction, and a rotatable handle extending from the housing in a forward direction. Rotation of the handle causes the helix to rotate about the display arm to thereby dispense the items of merchandise from the display arm in the forward direction. The time delay mechanism further includes a lock mechanism having a secured position for attaching the time delay mechanism to the display arm and an unsecured position for allowing the time delay mechanism to be detached from the display arm to permit bulk loading. A first drive gear may be affixed to the handle that engages a reducing gear that in turn engages a second drive gear affixed to the helix so that the second drive gear turns the helix slower than the handle turns the first drive gear.

12 Claims, 5 Drawing Sheets

(56) References Cited

U.S. PATENT DOCUMENTS

| | | | | |
|---|---|---|---|---|
| 7,533,784 | B2 * | 5/2009 | Vlastakis et al. | 221/258 |
| 7,559,437 | B2 * | 7/2009 | Colelli et al. | 221/312 A |
| 2003/0029816 | A1 * | 2/2003 | Huehner et al. | 211/7 |
| 2004/0084386 | A1 * | 5/2004 | Huehner et al. | 211/4 |
| 2005/0029283 | A1 * | 2/2005 | Pedigo | 221/289 |
| 2006/0157431 | A1 * | 7/2006 | Nagelski et al. | 211/54.1 |
| 2007/0283615 | A1 * | 12/2007 | Vlastakis et al. | 43/55 |
| 2008/0169250 | A1 | 7/2008 | Nagelski | |
| 2008/0209960 | A1 * | 9/2008 | Nagelski | 70/57.1 |
| 2009/0057244 | A1 * | 3/2009 | Conti et al. | 211/7 |
| 2009/0095695 | A1 | 4/2009 | Moock et al. | |
| 2010/0206825 | A1 * | 8/2010 | Johnston et al. | 211/59.2 |
| 2010/0223965 | A1 * | 9/2010 | Richardson et al. | 70/58 |
| 2010/0280655 | A1 * | 11/2010 | Wilson et al. | 700/231 |
| 2011/0127225 | A1 | 6/2011 | Hooks, Jr. et al. | |
| 2012/0097622 | A1 * | 4/2012 | Surma et al. | 211/7 |

* cited by examiner

MERCHANDISE DISPLAY HOOK HAVING TIME DELAY MECHANISM INCLUDING HELIX

CROSS REFERENCE TO RELATED APPLICATION

This non-provisional application claims the benefit of U.S. Provisional Application No. 61/233,331, filed Aug. 12, 2009, the entire disclosure of which is incorporated herein by reference.

FIELD OF THE INVENTION

This invention relates generally to merchandise display hooks for displaying items of merchandise on a display fixture. More particularly, the invention is a merchandise display hook having a time delay mechanism including a helix for increasing the amount of time required to dispense an item of merchandise from the display hook, while permitting bulk loading of multiple items of merchandise onto the display hook.

BACKGROUND AND RELATED ART

Merchandise display hooks are utilized extensively to display items of merchandise, for example, in a retail store. Typically, a plurality of display hooks are each individually mounted on a generally vertical display fixture, such as a conventional slat wall or slot wall, wire grid, bar rack or pegboard. The use of multiple display hooks on the display fixture provides an aesthetic and organized display area that allows potential purchasers to view the items or merchandise without assistance from sales personnel. Typically, the items of merchandise are retained within transparent packaging or within a transparent container, referred to as "keeper," configured to be suspended from a supporting arm, wire or rod (collectively referred to herein as the "support rod") of the merchandise display hook. In many instances, the value of the items of merchandise warrants the use of a display hook having one or more anti-theft features. It is known to provide the support rod of a merchandise display hook that supports "high risk" merchandise with a series of S-bends adjacent the free end of the support rod to prevent a shoplifter from "sweeping" all of the items off the display hook. It is also known to provide a mechanical time delay mechanism adjacent the free end of the support rod to increase the time required to dispense each item of merchandise from the display hook. It is also known to provide the display hook with a locking device configured to be positioned on the support rod between the free end and at least one of the items of merchandise. The S-bend and time delay mechanism types of anti-sweep theft protection do not require the assistance of sales personnel to dispense items of merchandise from the support rod, while an anti-sweep locking device requires a special key and assistance from sales personnel to dispense an item of merchandise that is supported on the support rod between the locking device and the display fixture.

Anti-sweep features such as S-bends, time delay mechanisms and locking devices are generally effective at reducing or preventing sweeping. Accordingly, determined shoplifters have resorted to forcibly removing the entire display hook, along with the items of merchandise, from the display fixture. Typically, the display hook must be rotated, tilted or angled upwardly sufficiently to disengage the mounting structure of the display hook from the display fixture. In a particular example, the display hook includes a pair of mounting pegs, referred to herein as "antlers," that are inserted through apertures formed in the display fixture. The display hook is commonly known as a "peg hook" and the display fixture is commonly known as "pegboard." The antlers engage the rear surface of the pegboard, while another mounting feature of the peg hook engages the front surface to mount the peg hook on the pegboard. As a result, it is intentionally time consuming to remove the peg hook from the pegboard, especially with the presence of other display hooks nearby. Despite the significant time and difficulty required to remove a peg hook from a pegboard display fixture, an appreciable number of retailers have found it desirable to utilize a peg hook including a locking base. The locking base prevents the peg hook from being rotated, tilled or angled sufficiently to disengage the antlers from the apertures of the pegboard, thereby preventing the display hook from being forcibly removed from the display fixture along with the items of merchandise.

The combination of an anti-sweep feature and a locking base provides a comprehensive theft prevention system for a merchandise display hook. The S-bend type of anti-sweep theft protection is inexpensive, but is less effective than a time delay mechanism or a locking device since a skilled shoplifter can manipulate items of merchandise along the S-bend and off the free end of the support rod fairly quickly. Furthermore, the S-bend provides no audible or visible indication to sales personnel that a shoplifter is attempting to sweep items of merchandise off the support rod. A locking device is more effective than the S-bend and the time delay mechanism types of anti-sweep theft protection since items of merchandise between the locking device and the display fixture are secured (i.e. locked) onto the support rod. However, as previously mentioned, assistance from sales personnel is required to dispense those items of merchandise from the support rod. Accordingly, many retailers permit a small number of the items of merchandise to be displayed on the display hook between the locking device and the free end of the support rod. As a result, a time delay mechanism is typically the most cost effective and reliable type of anti-sweep theft protection for reducing or eliminating the theft of all of the items of merchandise displayed on a display hook.

Existing time delay mechanisms, however, include features or characteristics that may frustrate potential purchasers. One such time delay mechanism is shown and described in United States Patent Application Publication No. 2009/0095695 A1 published Apr. 16, 2009, and assigned to the assignee of the present invention. That time delay mechanism includes a pair of mechanically interlocked time delay arms medially disposed on the support rod. The time delay arms are sequentially movable to permit a purchaser to manipulate an item of merchandise past the time delay arms one at a time for removal from the display hook. However, it may be difficult for a potential purchaser with limited dexterity to successfully manipulate an item of merchandise off the support rod. Furthermore, the items of merchandise typically must be loaded onto the support rod individually (i.e., one at a time). In some instances, a small number of relatively thin items of merchandise can be loaded onto the support rod at the same time by increasing the distance between the adjustable time delay arms. However, the time delay mechanism is not configured to permit rapid stocking of all of the items of merchandise onto the support rod at one time, commonly referred to in the art as "bulk loading."

Another existing time delay mechanism is shown and described in U.S. Pat. No. 7,533,784 B2 issued May 19, 2009, and assigned to Rock-Tenn Shared Services, LLC of Norcross, Ga. That time delay mechanism includes a dispensing gate that allows a single item of merchandise to be dispensed from a support rod upon rotation of a knob to displace the dispensing gate relative to the merchandise. A timing motor produces a mechanical time-delay before the knob can be rotated again to dispense another item of merchandise. A stop, or lock, may also be provided to permit the dispensing gate to be retained in a position that allows bulk loading of the items of merchandise onto the support rod. The time delay mechanism, however, is fairly complex, costly to produce and subject to malfunction.

Yet another existing time delay mechanism is shown and described in U.S. Pat. No. 7,559,437 B2 issued Jul. 14, 2009, and assigned to Displays Plus, Inc. of Placentia, Calif. The time delay mechanism of the '437 patent is provided on a merchandise display hook commercially known as the "Spiral Anti-Sweep Hook" and available from FFR-DSI of Cleveland, Ohio. The Spiral Anti-Sweep Hook includes an elongate helical coil disposed about the support rod and affixed to a rotatable knob. When the knob, and consequently the helical coil, are rotated in a first direction (e.g. clockwise), the items of merchandise are individually dispensed from the support rod. The rate at which each item of merchandise is dispensed depends on the amount of time required to rotate the knob one full rotation (i.e., 360 degrees) since the knob and the helical coil are directly affixed to one another. Accordingly, it is possible to dispense items of merchandise from the support rod fairly quickly by rotating (i.e. spinning) the knob at a rapid rate. Furthermore, items of merchandise must be loaded onto the support rod one at a time by rotating the knob, and consequently the helical coil, in a second direction opposite the first direction (e.g., counter-clockwise). Accordingly, bulk loading of multiple items of merchandise at the same time is not possible.

Accordingly, there exists a need for a merchandise display hook for displaying items of merchandise on a display fixture having an improved time delay mechanism for increasing the amount of time required to dispense an item of merchandise from the display hook, while still permitting bulk loading of multiple items of merchandise onto the support rod of the display hook. There exists a more particular need for a merchandise display hook having a time delay mechanism that permits a potential purchaser with limited dexterity to successfully manipulate an item of merchandise off the support rod of the display hook. There exists a further more specific need for a merchandise display hook having a time delay mechanism that is not exceedingly complex, costly or subject to malfunction. There exists yet a further specific need for a merchandise display hook having a time delay mechanism that permits the rate at which each item of merchandise can be dispensed from the support rod of the display hook to be varied.

DETAILED DESCRIPTION OF PREFERRED EMBODIMENTS OF THE INVENTION

The accompany drawing figures illustrate one or more exemplary preferred embodiments of a merchandise display hook, indicated generally at 20, for mounting on a display fixture, such as a conventional slat wall or slot wall, wire grid, bar rack or aperture pegboard (not shown) to display items of merchandise in, for example, a retail store. Display hook 20 comprises a time delay mechanism, indicated generally at 40, constructed in accordance with the invention. The time delay mechanism 40 is operable for increasing the amount of time required to dispense an item of merchandise (not shown) from the display hook 20, while still permitting bulk loading of the items of merchandise onto the display hook. In the exemplary embodiments shown and described herein, the merchandise display hook 20 is a peg style display hook, also referred to herein as a "peg hook," suitable for mounting on a "pegboard" type of display fixture that is typically made of metal, plastic, cardboard or pressed board and has a plurality of spaced apart apertures formed therethrough. Although a peg hook 20 is shown and described herein for purposes of illustration and explanation, it will be readily apparent to those skilled in the art that the broad concept of the invention is applicable of other types of merchandise display hooks configured for mounting on different types of display fixtures, including for example slat wall or slot wall, wire grid or bar rack.

Figure 1:
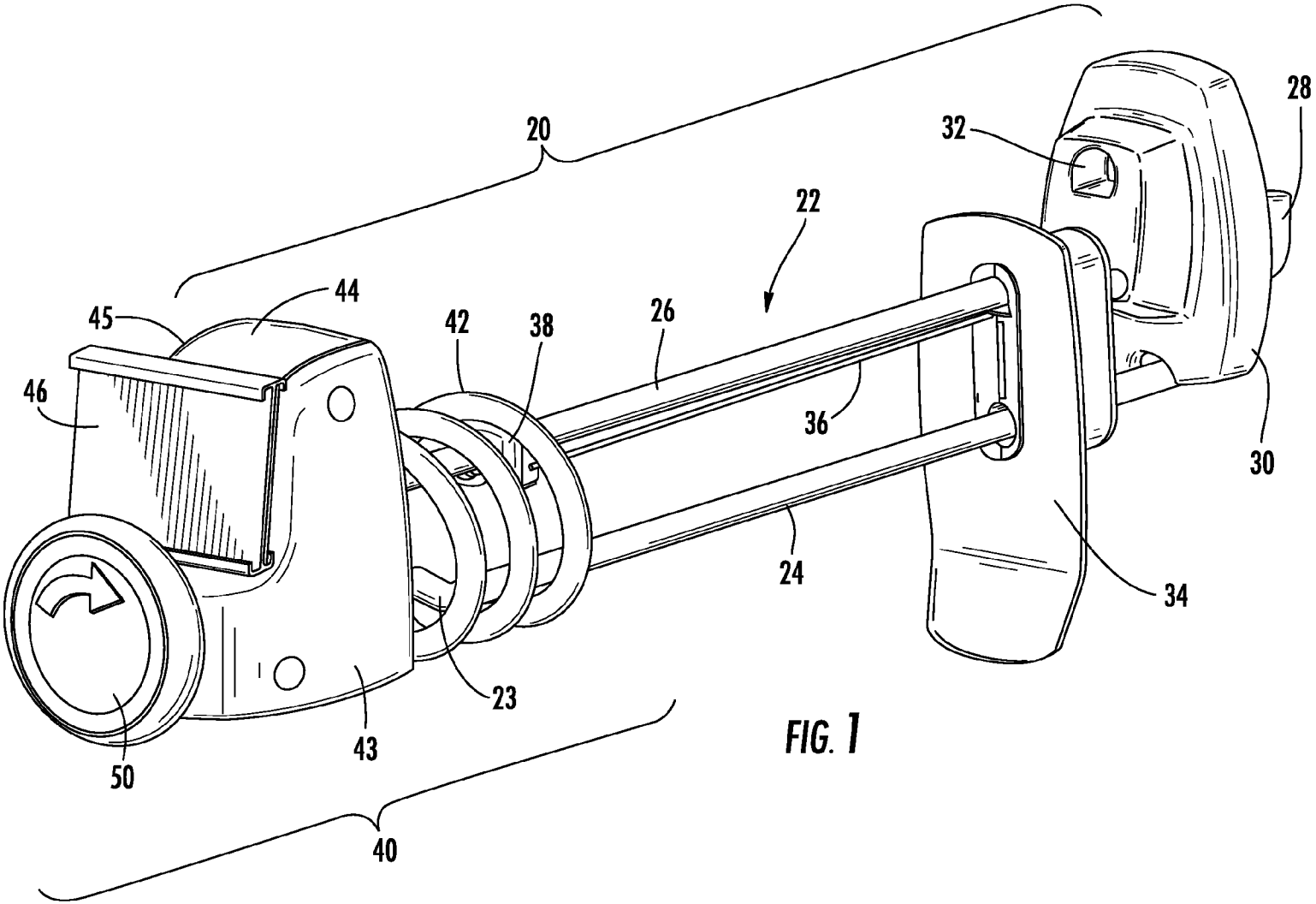
FIG. 1 is a right front perspective view of a merchandise display hook having a time delay mechanism constructed in accordance with the invention.
Figure 2:
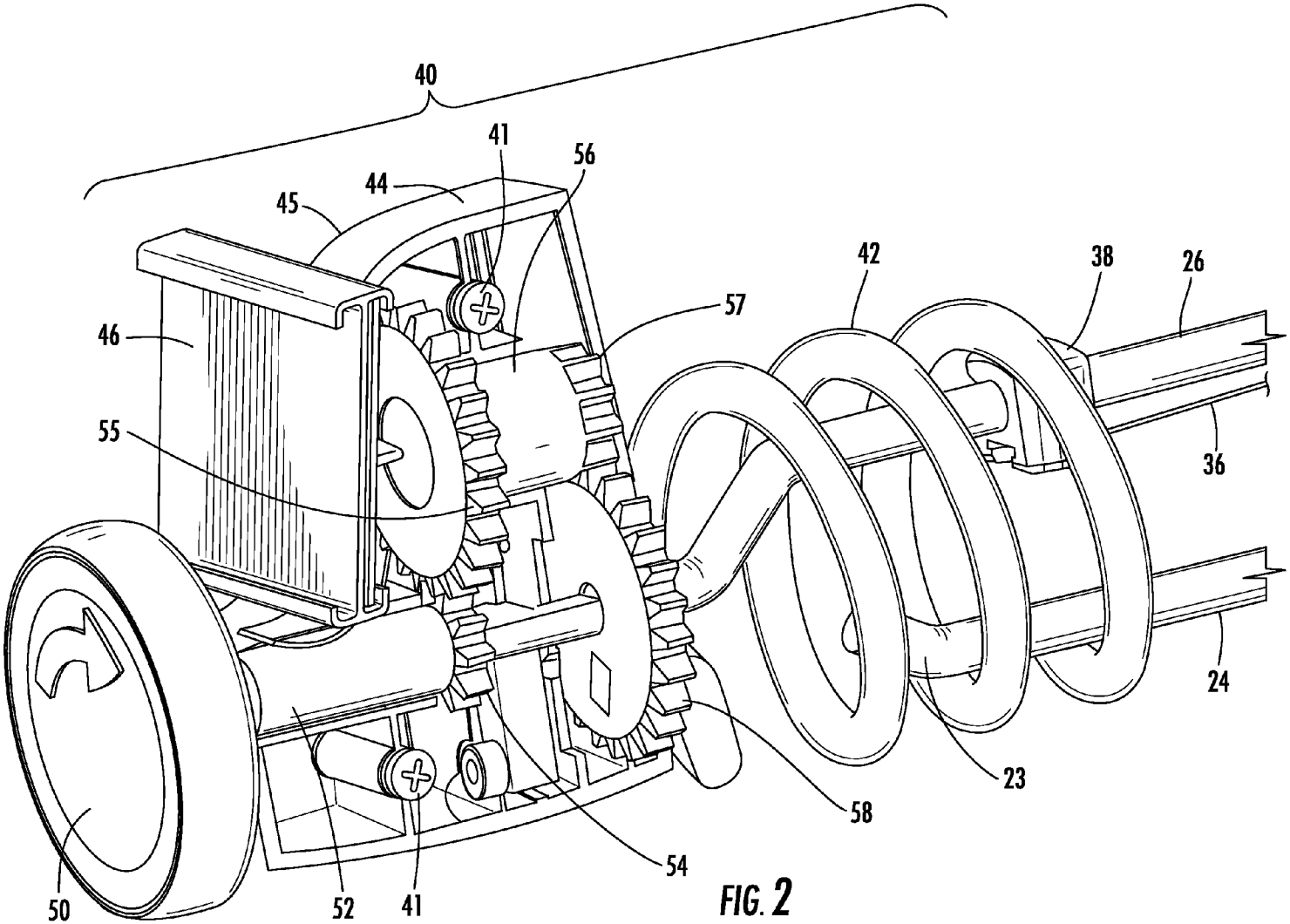
FIG. 2 is an enlarged right front perspective view of the time delay mechanism of the merchandise display hook of FIG. 1 shown with the right-hand portion of a housing removed for purposes of clarity.
Figure 5:
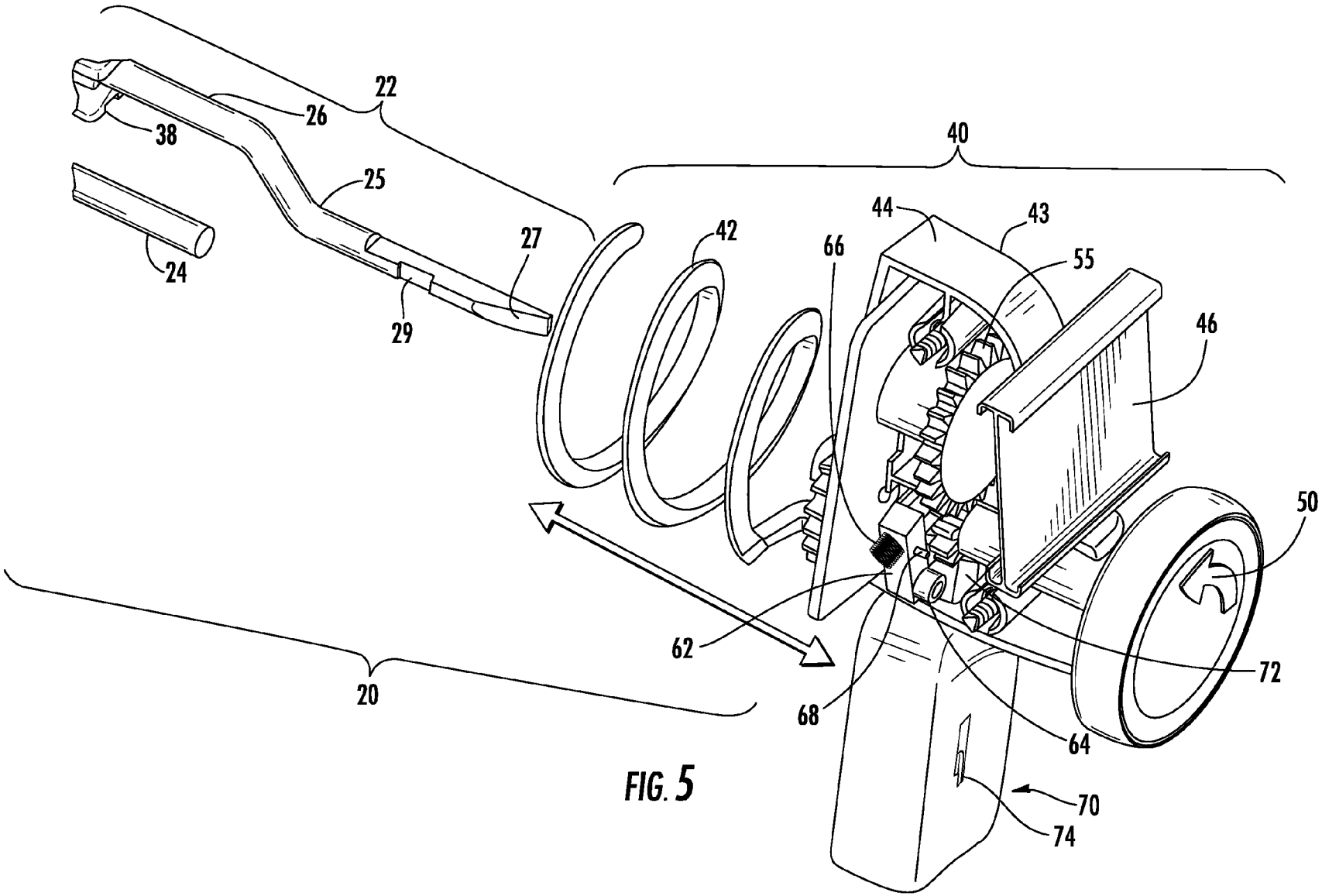
FIG. 5 is a left front perspective view of the time delay mechanism of the merchandise display hook of FIG. 1 shown with the left-hand portion of the housing removed for purposes of clarity and the lock mechanism in the unsecured position with the time delay mechanism detached from the display arm of the display hook.

FIG. 1 shows one embodiment of a peg hook 20 comprising a time delay mechanism 40 according to the invention that is configured for being mounted onto a conventional pegboard type of display fixture. Peg hook 20 further comprises a display arm 22 including a lower rod 24 and an upper rod 26. Lower rod 24 is typical of the lower rod provided on conventional merchandise display hooks and may comprise an upturned end portion 23 at a free end adjacent the time delay mechanism 40 for retaining an item of merchandise on the lower rod against the influence of gravity. However, the upturned end portion 23 is not essential since the time delay mechanism 40 serves to retain the merchandise on the lower rod 24, as will be described. Upper rod 26, however, is modified as best shown in FIG. 2 and FIG. 5 to cooperate with time delay mechanism 40, as will be described. Display arm 22 further comprises at least one, and preferably more than one, mounting peg 28 (partially visible in the perspective view of FIG. 1) for engaging an aperture formed through the pegboard to mount the peg hook 20 to the pegboard in a known manner.

In exemplary embodiments, the merchandise display hook 20 may further comprise a locking base 30 for locking the display hook, and in particular, display arm 22 to the corresponding display fixture. As shown herein, locking base 30 slides in a longitudinal (i.e., lengthwise) direction along upper rod 26 between an unlocked position at a distance from mounting peg(s) 28 and a locked position adjacent the mounting peg(s) in which the display fixture (i.e. pegboard) is disposed securely between the locking base and the upturned portion of the mounting peg(s). In this configuration, the display arm 22 cannot be angled upwardly and the mounting peg(s) retracted through the aperture(s) in the pegboard to thereby remove the display hook 20 from the display fixture. A recess 32 may be provided in the locking base 30 for receiving a magnetic key 70 (as will be described further with reference to FIGS. 3-5) operable for unlocking the locking base to thereby permit the display hook 20 to be removed from the display fixture in the manner described above. A locking base and magnetic key suitable for use with the invention is described in greater detail in United States Patent Application Publication No. 2008/0169250, published on Jul. 17, 2008, the entire disclosure of which is incorporated herein by reference. The display hook 20 further includes a conventional pusher device, commonly referred to as a "forward-facer," comprising a pusher plate 34 housing a coil spring 36 attached to a forward spring receiver 38 positioned on the upper rod 26 adjacent the time delay mechanism 40. The pusher plate 34 operates to bias the items of merchandise suspended from lower rod 24 in a forward direction away from the display fixture so that the outermost item of merchandise is positioned to engage the time delay mechanism 40, as will be described. An example of a conventional pusher device is shown and described in U.S. Pat. No. 6,464,089 B1 and is available from Vulcan Spring and Manufacturing Company of Telford, Pa.

In operation, the display hook 20 is first mounted onto the display fixture. In the exemplary embodiment shown and described herein, the display hook 20 is tilted upwardly and the mounting peg(s) 28 of the display arm 22 are inserted through the apertures formed in the pegboard. The display hook is then tilted downwardly until the display arm 22 is cantilevered from the pegboard in a generally horizontal orientation. The locking base 30, which was previously unlocked and slid forward on upper rod 26 to allow the mounting peg(s) 28 to be inserted through the apertures of the pegboard, is then slid rearward to the locked position abutting the pegboard such that the pegboard is disposed securely between the locking base and the upturned end portion(s) of the mounting peg(s). The time delay mechanism 40 is next detached from the display hook 20, and more particularly, from the upper rod 26 of the display arm 22, as will be described. The lower rod 24, which is commonly referred to as the support rod, can then be stocked with a number of the items of merchandise by bulk loading. As used herein, the term "bulk loading" refers to the ability to stock the display hook with multiple items of merchandise at the same time without having to feed each item of merchandise one at a time through the time delay mechanism in a reverse direction. Alternatively, the display hook 20 can be first mounted onto the display fixture as described above with the time delay mechanism 40 detached. If not already stocked, the lower rod 24 is next stocked with the items of merchandise by bulk loading. The time delay mechanism 40 can then be mounted onto the display arm 22, and more particularly, onto the upper rod 26. Regardless, the pusher plate 34 is then released from its rearward-most position shown in FIG. 1 to bias the items of merchandise in the forward direction so that the outermost item of merchandise engages the time delay mechanism 40.

FIG. 2 is an enlarged perspective view of the time delay mechanism 40 mounted onto the display arm 22, and more particularly, onto the upper rod 26 of the display arm. The time delay mechanism 40 comprises a relatively short segment of a helical coil, or helix, 42 extending in a rearward direction from a housing 44. The housing 44 is preferably constructed in two portions removably secured together by one or more conventional fasteners 41, for example threaded screws. Alternatively, the components of the time delay mechanism 40 may be assembled and the portions of the housing 44 may then be permanently fused together, for example by heat sealing or ultrasonic welding, to prevent subsequent tampering by a potential shoplifter. As shown, housing 44 comprises a right-hand portion 43 (removed in FIG. 2 for purposes of clarity) and a left-hand portion 45 as viewed from the perspective of a potential purchaser (i.e., looking from the front of the housing 44 towards the display fixture). The helix 42 is a conventional spring type helical coil having a constant pitch. As used herein, the term "pitch" refers to the distance between corresponding points on adjacent coils of the helix. However, a helix having a variable pitch may be used as desired to vary the distance an item of merchandise is moved lengthwise along the lower rod 24 of the display arm 22 for one full (i.e. 360 degrees) rotation of the helix. In the exemplary embodiments shown and described herein, the pitch of the helix 42 is sufficient to accommodate the thickness of the packaging and/or keeper containing the item of merchandise, while preventing a potential shoplifter from accessing the opening formed in the packaging or keeper that receives the lower rod 24 of the display arm 22. In this manner, a potential shoplifter is prevented from cutting the packaging or keeper on either side of the opening and removing the item of merchandise off the lower rod 24 between adjacent coils of the helix 42. The time delay mechanism 40 further comprises a conventional label holder 46 attached to an external surface of the housing 44 in a suitable position and manner, as well as a rotatable knob, or handle, 50 extending from the housing 44 in a forward direction for a purpose to be described.

Housing 44 defines an internal cavity or compartment for receiving various components of the time delay mechanism 40. As best viewed from the perspective shown in FIG. 2, time delay mechanism 40 comprises an elongate shaft 52 rigidly attached at its forward end to handle 50 and rigidly affixed at its rearward end to a first drive gear 54. Drive gear 54 is provided with a plurality of gear teeth that engage, and more particularly, mesh with corresponding gear teeth on a larger diameter portion 55 of a reducing gear 56. Reducing gear 56 comprises a smaller diameter portion 57 opposite and rearward of the larger diameter portion 55 that is provided with a plurality of gear teeth that engage, or mesh with, corresponding gear teeth on a second drive gear 58. In turn, second drive gear 58 is rigidly affixed to helix 42. Second drive gear 58 has a significantly larger diameter than first drive gear 54 so that the second drive gear 58 turns helix 42 at a slower rate than the rate at which handle 50 turns first drive gear 54. As a result, the rate at which the helix 42 turns is proportional to, but substantially slower than, the rate at which a potential purchaser turns handle 50 to dispense an item of merchandise from the lower rod 24 of the display arm 22.

In a particular example, the reducing gear 56 causes the second drive gear 58, and consequently helix 42, to turn at approximately one-sixth the rate at which the handle 50 is turned. In other words, six full turns (i.e., six 360 degree revolutions) of the handle 50 are required to move the helix 42 through one full turn to thereby advance an item of merchandise along the lower rod 24 of the display arm 22 a distance equal to the pitch of the helix. In this example, a potential purchaser is required to rotate the handle 50 a total of six full turns (2160 degrees) to dispense an item of merchandise suspended from the lower rod 24 of the display arm 22 between adjacent coils of the helix 42 at the upturned end 23 of the lower rod. Accordingly, a potential shoplifter is deterred from attempting to rapidly dispense multiple items of merchandise from the display hook 20. A 6:1 reducing ratio between the rate at which handle 50 is turned and the rate at which helix 42 turns has been described for purposes of explanation and illustration. However, those of ordinary skill in the art will readily recognize, understand and appreciate that any desired reducing ratio may be selected and the first drive gear 54, the reducing gear 56 and the second drive gear 58 may be constructed in any suitable manner to produce the desired reduction between turns of handle 50 and corresponding turns of helix 42. Furthermore, the reducing rate may be reversed if desired such that the helix 42 turns at a greater rate than the handle 50. Such an embodiment may be desirable if, for example, the diameter of the handle 50 is significantly greater than the diameter of the helix 42.

Figure 3:
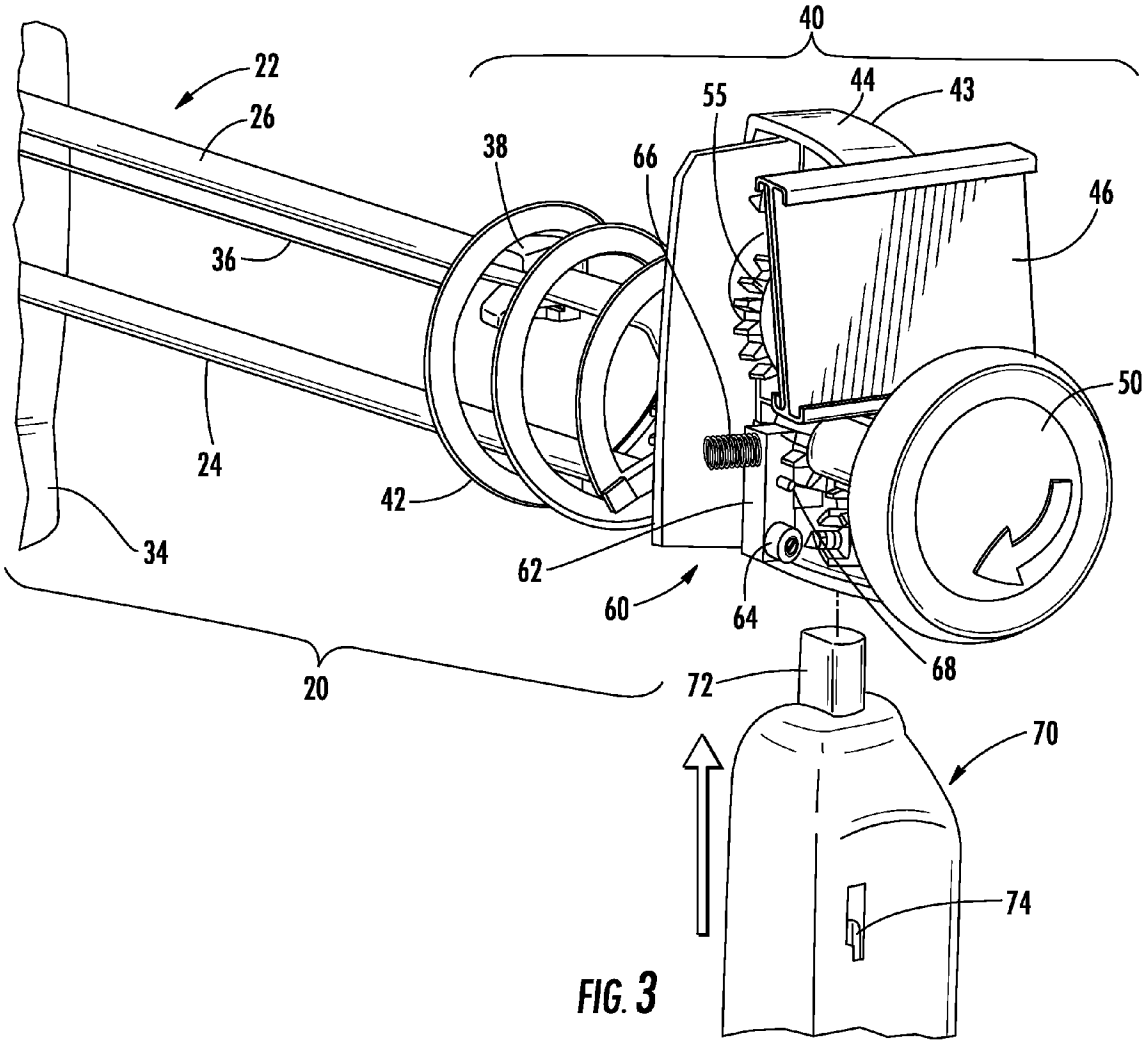
FIG. 3 is a left front perspective view of the time delay mechanism of the merchandise display hook of FIG. 1 shown with the left-hand portion of the housing removed for purposes of clarity and a lock mechanism in a secured position with the time delay mechanism attached to a display arm of the display hook.
Figure 4:
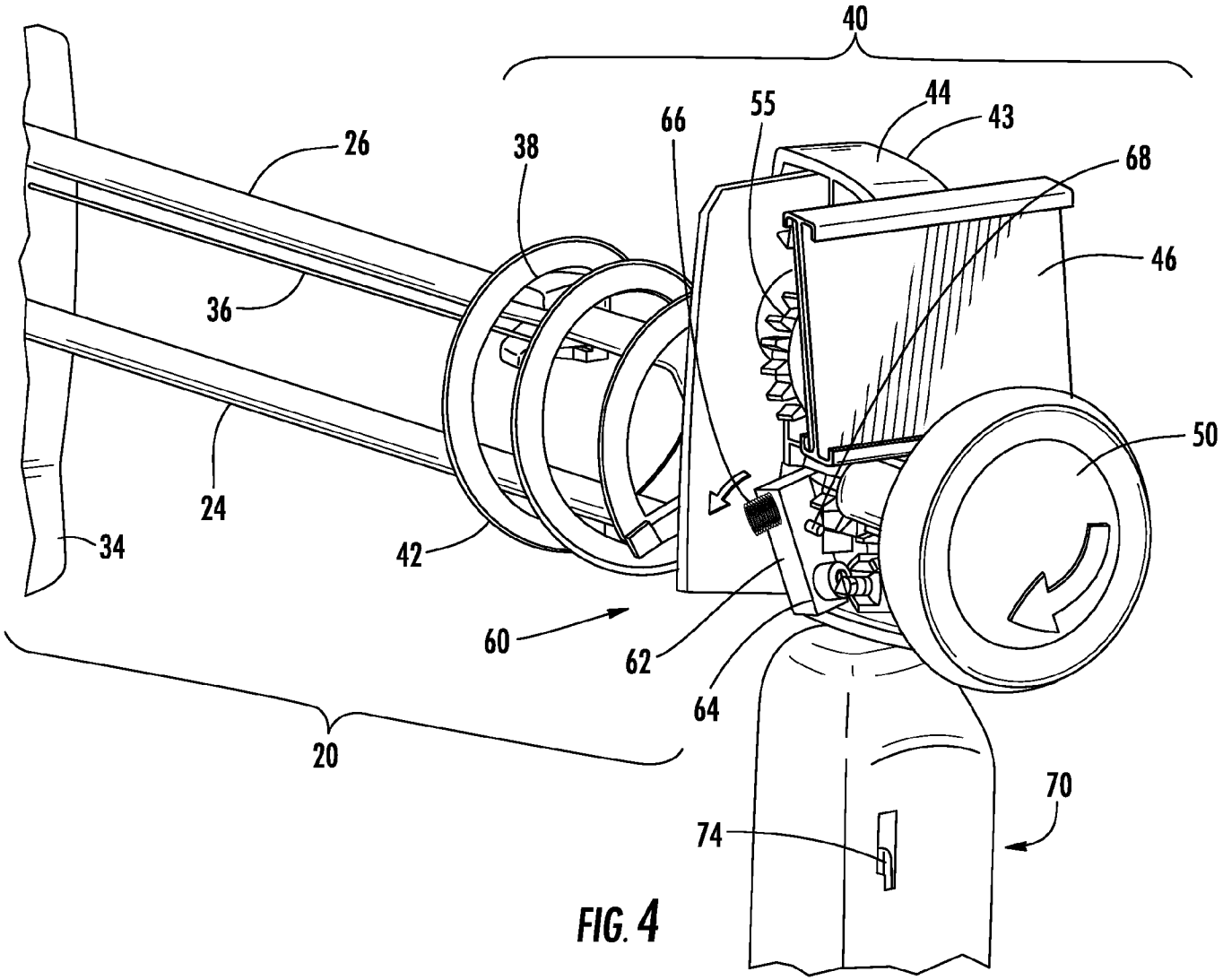
FIG. 4 is a left front perspective view of the time delay mechanism of the merchandise display hook of FIG. 1 shown with the left-hand portion of the housing removed for purposes of clarity and the lock mechanism in an unsecured position.

FIGS. 3-5 illustrate a display hook 20 including a time delay mechanism 40 according to the invention that is configured to permit bulk loading of multiple items of merchandise onto the lower rod 24. In FIGS. 3-5, the left-hand portion (indicated by 45 in FIG. 1 and FIG. 2) of housing 44 has been removed for purposes of clarity. Time delay mechanism 40 further comprises a lock mechanism 60 disposed within the internal cavity, or compartment, defined by housing 44. Lock mechanism 60 is operable for securely attaching the time delay mechanism 40 to the display arm 22 of the display hook 20 and for permitting the time delay mechanism to be detached from the display arm to stock items of merchandise onto the lower rod 24 by bulk loading. As shown, lock mechanism 60 comprises a shuttle 62 having a stud 64 at one end that is made of a magnetically attractive material, and a spring 66 at the opposite end that is disposed between the shuttle and an inner wall of the housing 44. The shuttle 62 is rotatably mounted on a pin 68 that is positioned medially along the length of the shuttle. The spring 66 biases the shuttle 62 towards a secured position wherein the shuttle engages an undercut portion, or notch, 29 (FIG. 5) formed in an end portion 25 (FIG. 5) of the upper rod 26 to securely attach the time delay mechanism 40 to the display arm 22 of the display hook 20. A recess (not visible) formed in the housing 44 adjacent the stud 64 of the shuttle 62 is sized and shaped to receive a magnetic key 70 of the type described in United States Patent Application Publication No. 2008/0169250. Magnetic key 70 comprises an actuator 72 that is configured to be extended outwardly by a movable actuator button 74 into the recess formed in the housing 44 of the time delay mechanism 40. The actuator 72 is extended into the recess of the housing 44 in the direction indicated by the linear single-headed arrow in FIG. 3. Preferably, the actuator 72 of magnetic key 70 and the recess formed in the housing 44 have a complimentary proprietary shape. As shown herein, the actuator 72, and consequently the recess formed in the housing 44, are each generally D-shaped. Thus, the actuator 72 comprises a generally planar portion, or face, and a generally arcuate portion, or face.

FIG. 4 shows the actuator 72 of the magnetic key 70 disposed within the recess of the housing 44 and the lock mechanism 60 in an unsecured position. The actuator 72 of the magnetic key 70 includes a magnet defining a magnetic force field that attracts the stud 64 towards the actuator, thereby causing the shuttle 62 to rotate about pin 68 against the biasing force of the spring 66. In this manner, shuttle 62 is moved out of engagement with the undercut 29 formed in end portion 25 of upper rod 26 so that the time delay mechanism 40 is no longer securely attached to the display arm 22 of display hook 20. In particular, shuttle 62 rotates about pin 68 in the direction indicated by the curved single-headed arrow in FIG. 4. As will be readily understood and appreciated by those skilled in the art, shuttle 62 (or at least the end of the shuttle adjacent the recess formed in housing 44) may be made of a magnetically attractive material, and consequently, stud 64 may be eliminated. In this embodiment, the end of the shuttle 62 is attracted by the magnetic force field towards the actuator 72 of the magnetic key 70 to disengage the shuttle from the undercut 29 formed in the end portion 25 of the upper rod 26. Furthermore, the end portion 25 of the upper rod 26 may comprise a downturned portion that is positioned outwardly beyond the end of the lower rod 24 such that the undercut 29 and the lock mechanism 60 may be disposed in a lower portion of the housing 44 below the other components of the time delay mechanism 40 to provide a more compact assembly.

FIG. 5 shows the actuator 72 of the magnetic key 70 still disposed within the recess of the housing 44 of the time delay mechanism 40 and the lock mechanism 60 still in the unsecured position. In this configuration, the time delay mechanism 40 may be detached (as shown) from the upper rod 26 of the display arm 22 so that multiple items of merchandise may be stocked on the lower rod 24 of the display arm at the same time by bulk loading. In this same configuration, the time delay mechanism 40 may be reattached to the upper rod 26 of the display arm 22 once the items of merchandise have been stocked on the lower rod 24. The time delay mechanism 40 is detached from the display arm 22 and reattached to the display arm by moving the time delay mechanism along with the magnetic key 70 in a forward and rearward direction, respectively, as indicated by the linear double-headed arrow in FIG. 5. If desired, the actuator 72 of the magnetic key 70 may be withdrawn from the recess formed in the housing 44 once the shuttle 62 has been displaced in a forward direction beyond the undercut 29 formed in the upper rod 26 of the display arm 22. Furthermore, the end portion 25 of the upper rod 26 may be provided with a cam surface, or ramp, 27. The ramp 27 is operable for gradually displacing shuttle 62 against the biasing force of spring 66 as the time delay mechanism 40 is guided over end portion 25 of upper rod 26 in the direction of undercut 29. Accordingly, it is not necessary for actuator 72 of magnetic key 70 to be disposed within the recess formed in housing 44 to reattach the time delay mechanism 40 onto display arm 22 of display hook 20. Regardless, once shuttle 62 is positioned opposite undercut 29 of upper rod 26 without actuator 72 of magnetic key 70 disposed within the recess formed in housing 44, the biasing force of spring 66 causes the shuttle to rotate about pin 68 back to the secured position so that time delay mechanism 40 is securely attached to display arm 22 of display hook 20.

The foregoing has described one or more exemplary preferred embodiments of a merchandise display hook for suspending and displaying items of merchandise on a display fixture including a time delay mechanism according to the invention. The time delay mechanism is operable for increasing the amount of time required to dispense an item of merchandise from the display hook. The time delay mechanism is further operable for permitting bulk loading of multiple items of merchandise onto the display hook at one time with or without the display hook mounted on the display fixture. Preferred embodiments of the display hook and time delay mechanism have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise display hook for supporting and dispensing items of merchandise comprising:

a display arm having a first end for attachment to a display fixture and a second end extending in a forward direction away from the display fixture, the display arm comprising an elongate first rod extending from the first end to the second end and an elongate second rod extending from the first end to the second end and configured for supporting the items of merchandise on the display arm; and a time delay mechanism configured to be removably attached to at least one of the first rod and the second rod adjacent the second end, the time delay mechanism comprising a helix that is at least partially disposed about both the first rod and the second rod;

wherein the helix is operable for increasing the amount of time required for dispensing the items of merchandise from the second rod at the second end of the display arm, while permitting bulk loading of the items of merchandise onto the second rod at the second end of the display arm.

2. A merchandise display hook according to claim 1, wherein the time delay mechanism further comprises a housing and wherein the helix extends from the housing in a rearward direction towards the display fixture.

3. A merchandise display hook according to claim 1, wherein the helix is disposed about both the first rod and the second rod at the second end of the display arm.

4. A merchandise display hook according to claim 1, wherein the time delay mechanism further comprises a rotatable handle that is operable for rotating the helix about both the first rod and the second rod at the second end of the display arm.

5. A merchandise display hook for supporting and dispensing items of merchandise comprising:

a display arm having a first end for attachment to a display fixture and a second end extending in a forward direction away from the display fixture for supporting the items of merchandise on the display arm adjacent the second end; and a time delay mechanism configured to be removably attached to the second end of the display arm;

wherein the time delay mechanism comprises a housing and a helix extending from the housing in a rearward direction towards the display fixture, the helix being at least partially disposed about the second end of the display arm;

wherein the time delay mechanism further comprises a rotatable handle extending from the housing in the forward direction and wherein the handle is operable for rotating the helix about the second end of the display arm;

wherein the time delay mechanism further comprises a first drive gear affixed to the handle and wherein the first drive gear is provided with a plurality of gear teeth that engage a plurality of gear teeth provided on a larger diameter portion of a reducing gear; and wherein the time delay mechanism is operable for increasing the amount of time required for dispensing the items of merchandise from the second end of the display arm, while permitting bulk loading of the items of merchandise onto the second end of the display arm.

6. A merchandise display hook according to claim 5, wherein the reducing gear comprises a smaller diameter portion opposite the larger diameter portion in the rearward direction that is provided with a plurality of gear teeth that engage a plurality of gear teeth provided on a second drive gear.

7. A merchandise display hook according to claim 6, wherein the second drive gear is affixed to the helix so that rotation of the handle results in rotation of the helix about the second end of the display arm.

8. A merchandise display hook according to claim 7, wherein the second drive gear has a larger diameter than the first drive gear so that the second drive gear turns the helix at a slower rate than the rate at which the handle turns the first drive gear.

9. A merchandise display hook for supporting and dispensing items of merchandise comprising:

a display arm having a first end for attachment to a display fixture and a second end extending in a forward direction away from the display fixture for supporting the items of merchandise on the display arm adjacent the second end; and a time delay mechanism configured to be removably attached to the second end of the display arm; and a lock mechanism disposed within the time delay mechanism, the lock mechanism having a secured position for attaching the time delay mechanism to the second end of the display arm and an unsecured position for allowing the time delay mechanism to be detached from the second end of the display arm, wherein the lock mechanism further comprises a shuttle that is biased by a biasing force of a spring into engagement with a notch formed in the second end of the display arm in the secured position;

wherein at least a portion of the shuttle is made of a magnetically attractable material and wherein a magnetic force field attracts the portion of the shuttle against the biasing force of the spring from the secured position to the unsecured position; and wherein the time delay mechanism is operable for increasing the amount of time required for dispensing the items of merchandise from the second end of the display arm, while permitting bulk loading of the items of merchandise onto the second end of the display arm.

10. A merchandise display hook according to claim 1, further comprising a pusher device positioned medially between the display fixture and the time delay mechanism for moving the items of merchandise in the forward direction towards the second end of the display arm.

11. A merchandise display hook according to claim 1, further comprising a locking base disposed on the display arm adjacent the first end, the locking base operable for locking the display arm to the display fixture to prevent removal of the display arm from the display fixture in a locked position and for allowing removal of the display arm from the display fixture in an unlocked position.

12. A merchandise display hook according to claim 1, wherein the display arm comprises a lower rod for supporting the items of merchandise and an upper rod configured for receiving and removably attaching the time delay mechanism to the display arm.

* * * * *